US005240186A

United States Patent [19]

Dobbins et al.

[11] Patent Number: 5,240,186

[45] Date of Patent: Aug. 31, 1993

[54] PORTABLE ELECTROSTATIC LIQUID SPRAYER

[75] Inventors: Richard B. Dobbins, Houston, Tex.; James D. Brown, London, Canada

[73] Assignee: Southwest Electrostatic Sprayers, Inc., Houston, Tex.

[21] Appl. No.: 801,967

[22] Filed: Dec. 3, 1991

[51] Int. Cl.[5] ..... B05B 5/043; B05B 5/053; B05B 9/08

[52] U.S. Cl. ..... 239/690.1; 239/704; 239/154

[58] Field of Search ..... 239/690, 690.1, 704, 239/706, 708, 152-154; 123/537, 538

[56] References Cited

U.S. PATENT DOCUMENTS

| | | | |
|---|---|---|---|
| 2,958,155 | 11/1960 | Emmerich | 239/153 |
| 4,082,070 | 4/1978 | Säufferer et al. | 239/704 |
| 4,396,157 | 8/1983 | Inculet et al. | 239/598 |
| 4,673,132 | 6/1987 | Inculet et al. | 239/706 |

FOREIGN PATENT DOCUMENTS

| | | | |
|---|---|---|---|
| 246479 | 11/1962 | Australia | 239/152 |
| 2143153 | 2/1985 | United Kingdom | 239/704 |

*Primary Examiner*—Andres Kashnikow
*Assistant Examiner*—Karen B. Merritt
*Attorney, Agent, or Firm*—Pravel, Hewitt, Kimball & Krieger

[57] ABSTRACT

A portable electrostatic liquid sprayer including a small internal combustion engine with a magneto-type ignition system providing a high voltage source to inductively charge atomized droplets being sprayed onto crops or plants. A conductive voltage tap is coupled between a spark plug boot from the magneto and the high voltage terminal of a spark plug for access to the high voltage provided by the magneto. A wire is connected to the voltage tap and routed and connected to an RC filter and rectifier circuit mounted in the sprayer head. A ground wire is electrically coupled to the chassis of the engine and also routed and connected to the RC filter and rectifier circuit. An electrode mounted near the outlet of the sprayer head and connected to the RC filter and rectifier circuit establishes an electrostatic field within the sprayer head effective to inductively charge the atomized droplets as they are being ejected from the sprayer head.

9 Claims, 2 Drawing Sheets

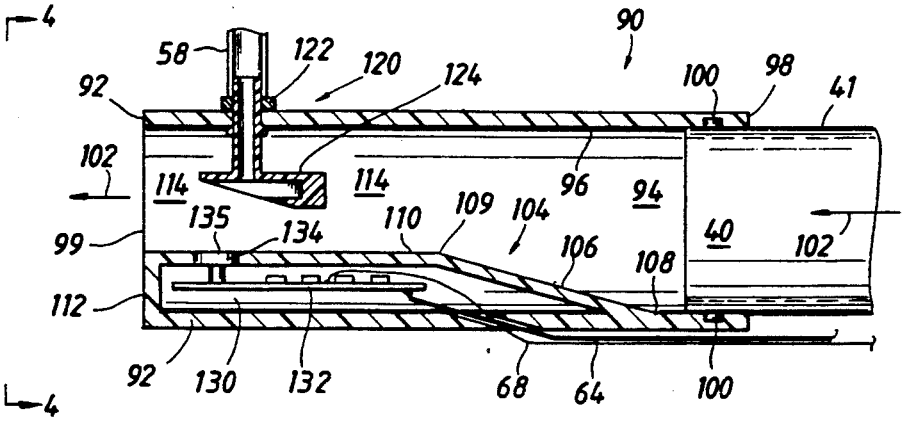
FIG. 3
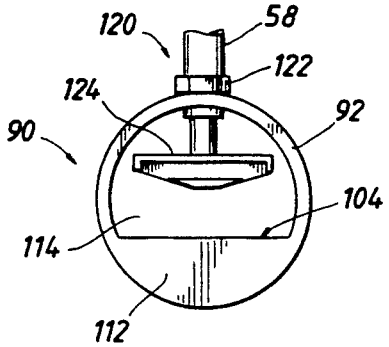
FIG. 4
FIG. 5
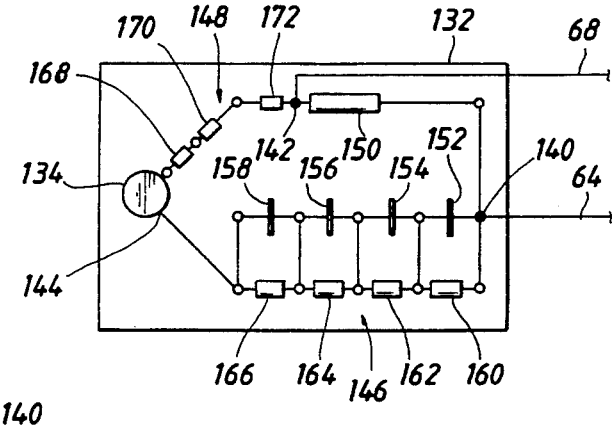
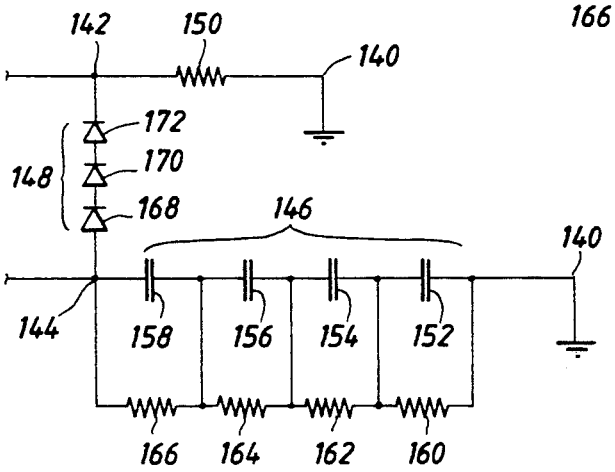
FIG. 6
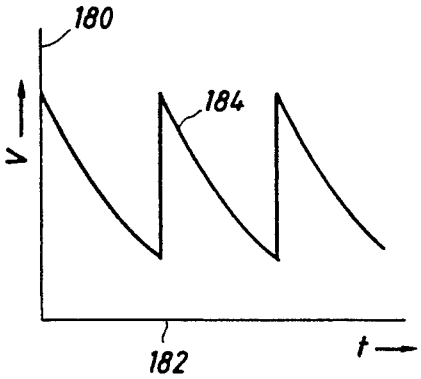
FIG. 7

PORTABLE ELECTROSTATIC LIQUID SPRAYER

BACKGROUND OF THE INVENTION

1. Field of the Invention

The present invention relates to a portable electrostatic liquid sprayer which is capable of being used while being carried by a person.

2. Description of the Related Art

A typical liquid sprayer uses an air compressor to blow air at a relatively high velocity through a sprayer head which extracts and atomizes liquid from a nozzle located in the sprayer head and deposits the atomized liquid onto crops or plants. An electrostatic sprayer electrostatically charges the atomized particles or droplets before they are expelled from the sprayer head to thereby improve the deposition of the droplets. The sprayer head and nozzle are typically made of a non-conducting material and are maintained at electrical ground. A high voltage is applied to a conductive electrode positioned near the outlet of the sprayer head to establish an electrostatic field capable of inductively charging the droplets issuing from the nozzle. Examples of electrostatic sprayers, which are known and are in use at the present time, are shown in U.S. Pat. Nos. 4,396,157 and 4,673,132 to Inculet et al.

Most electrostatic sprayers in use at the present time are relatively large and cumbersome since they require relatively large air compressors and liquid reservoirs for supplying the liquid to one or more nozzles in a large sprayer head or shroud. These relatively large and heavy sprayers are usually mounted on a tractor, truck, or other type of motorized vehicle or on a trailer pulled by the motorized vehicle. A high voltage source is required to supply a large enough voltage to the sprayer head electrode to induce the desired charge on the liquid particles. The high voltage source typically comprises a large and bulky battery coupled to a power pack for converting the low battery voltage to the necessary high voltage. The size and weight of the battery, liquid reservoir, compressor and other elements of existing electrostatic sprayers have been secondary considerations since these sprayers were intended to be carried by suitable tractors or other motorized vehicles.

It is desirable, however, to provide a portable electrostatic sprayer which is capable of being used while being carried by a person. The electrostatic sprayers currently being used are unsuitable for this purpose for a plurality of reasons. First, the existing sprayers are much too large and heavy. Second, the sprayer heads typically have limited movement making them undesirable for manipulation by a single person to spray in variable directions. Third, even if some of the required elements are reduced in size to create a smaller sprayer, a high voltage source is still necessary and must be provided and carried along with the unit. It is not practical for a single person to carry the battery and power pack typically used on existing electrostatic sprayers.

Portable engine back-packs for blowers and sprayers are known, but so far as is known, no one has previously solved the problems of a portable back-pack type unit for electrostatic sprayers.

SUMMARY OF THE PRESENT INVENTION

The present invention is a portable electrostatic liquid sprayer which is capable of being used while being carried by a person. The portable sprayer includes a relatively small internal combustion engine used to drive an air blower and a suitably sized reservoir for carrying a sufficient amount of the liquid to be sprayed. An air tube is connected to the air blower to channel the air to a sprayer head mounted on an outlet of the air tube. The air tube is designed to be easily manipulated by an operator to allow the operator to spray the liquid in any desired direction. A nozzle is mounted inside of the sprayer head near the outlet of the sprayer head. A flexible hose is attached between the liquid reservoir and the nozzle to transport the liquid to the sprayer head. The sprayer head is fashioned with a venturi or narrowed outlet such that air provided from the air blower is accelerated through the sprayer head outlet providing a low pressure area which extracts liquid from the nozzle. The high velocity air stream further atomizes the liquid into small particles or droplets and projects the atomized droplets towards the crops or plants.

A high voltage electrode is mounted inside the sprayer head near the air outlet and the nozzle. The internal combustion engine includes a magneto-type ignition system and a spark plug which provides a high voltage source for the sprayer head electrode to inductively charge the atomized droplets in the sprayer head. A conductive means is adapted for connection between the spark plug terminal and a spark plug boot to tap the high voltage pulses from the magneto. A conductive wire is connected to the conductive means and routed to the sprayer head and connected to a resistor capacitor (RC) filter and rectifier circuit mounted on a circuit board located within the sprayer head. The high voltage electrode is also electrically coupled to the RC filter and rectifier circuit wherein the RC filter and rectifier circuit serves to convert the relatively narrow voltage pulses from the magneto to a saw-toothed voltage waveform thereby increasing the average voltage from the magneto to provide a more effective electrostatic field. A conductive ground wire is electrically coupled to the chassis of the internal combustion engine, routed to the sprayer head and connected to the RC filter and rectifier to complete the electrical circuit.

The magneto provides the necessary high voltage source for the electrostatic sprayer which is accessible at the spark plug. The filtered and rectified voltage applied to the sprayer head electrode establishes an electrostatic field which induces an electric charge on the atomized droplets before the droplets are expelled from the sprayer head. The charged droplets are electrostatically attracted to the leaves of the plants or crops being sprayed thereby increasing the efficiency of the spraying apparatus. The magneto and RC filter and rectifier circuit eliminates the need for the large and heavy battery and power pack typically required for existing electrostatic spraying devices. The present invention, therefore, provides for a relatively small, lightweight, convenient and highly effective portable electrostatic sprayer which is capable of being carried on the back of a person so that it can be used while being carried.

BRIEF DESCRIPTION OF THE DRAWINGS

A better understanding of the present invention can be obtained when the following detailed description of the preferred embodiment is considered in conjunction with the drawings, in which:

FIG. 3 is a partial cross-sectional view of a sprayer head of the electrostatic sprayer of the present invention;

FIG. 4 is a view taken along lines 4—4 of FIG. 3;

FIG. 5 is a top view of a circuit board upon which is mounted a resistor capacitor filter and rectifier circuit;

FIG. 6 is an electrical schematic diagram of the resistor capacitor filter and rectifier circuit of FIG. 5; and FIG. 7 is a graphical illustration of the saw-toothed voltage waveform applied to an electrode in the

DETAILED DESCRIPTION OF THE PREFERRED EMBODIMENT

Figure 1:
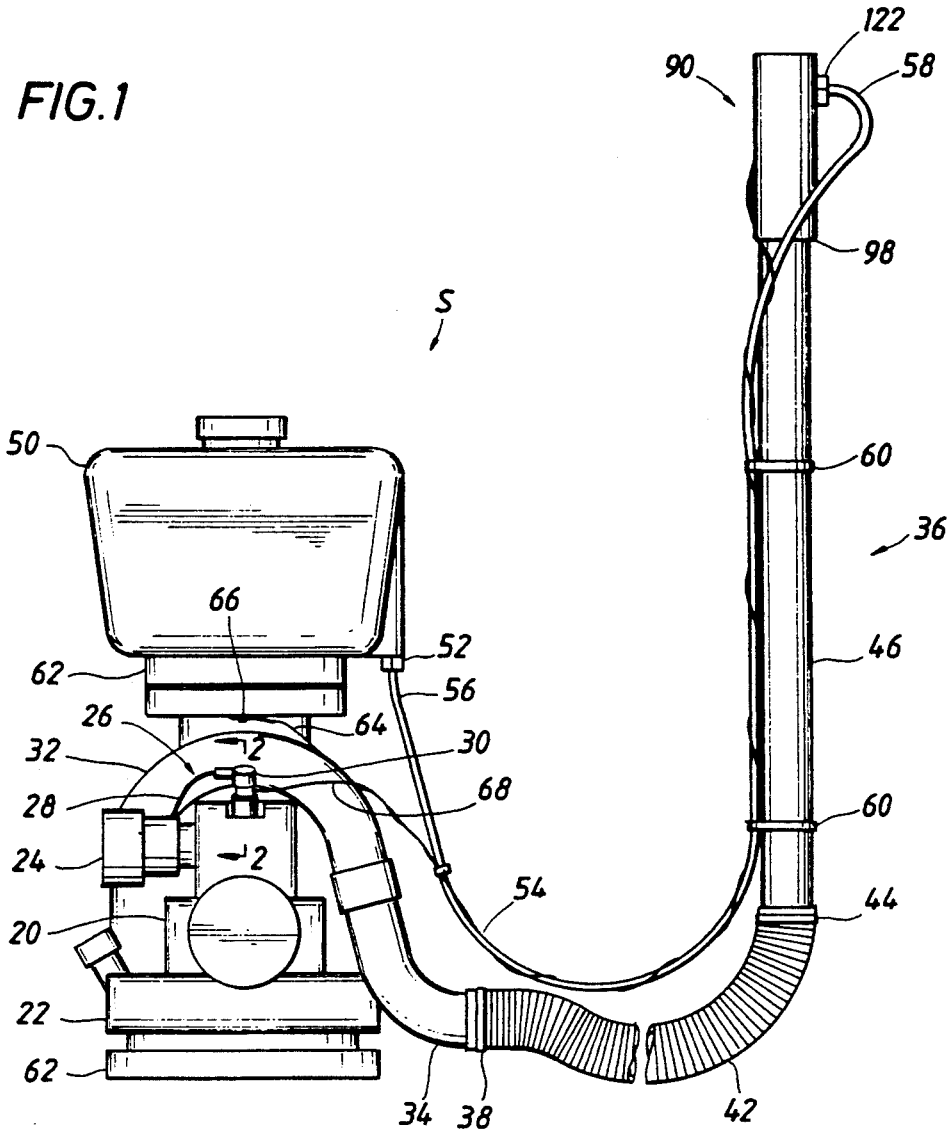
FIG. 1 is a front view of the portable electrostatic liquid sprayer of the present invention.
Figure 2:
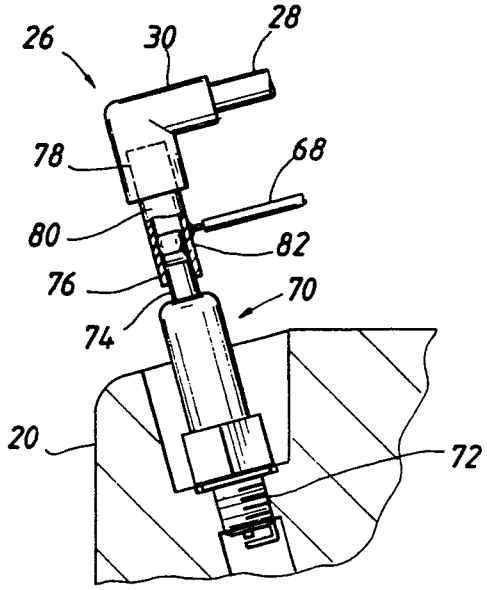
FIG. 2 is a view taken along lines 2—2 of FIG. 1 illustrating the voltage tap between a spark plug boot and a spark plug.

Referring now to FIG. 1, a front view of the portable electrostatic liquid sprayer generally referred to by the letter S is shown. A relatively small and lightweight internal combustion engine 20 is provided to supply the required power used to run the electrostatic sprayer S. The engine 20 is a conventional internal combustion engine which includes a fuel tank 22 used to hold gasoline or a gasoline-oil fuel mix for the engine 20. The internal combustion engine 20 includes a magneto-type ignition system 24 typically used to convert the mechanical power of the internal combustion engine 20 into electrical power comprising high voltage and current pulses of short duration provided to a spark plug 70 (FIG. 2).

The magneto 24 provides the high voltage to the spark plug 70 through a high voltage spark plug boot 26 which comprises a high voltage wire 28 connected between the high voltage output of the magneto 24 and a spark plug connector 30 which is adapted for electrical and mechanical connection to a high voltage terminal 74 of the spark plug 70. As will be described in more detail below, the connection between the spark plug boot 26 and the spark plug 70 provides for accessing the high voltage pulses from the output of the magneto 24 used to establish an electrostatic field to inductively charge the liquid particles to be sprayed on crops or plants. The internal combustion engine 20, the magneto 24 and the fuel tank 22 are preferably relatively small and lightweight so that the entire unit may be carried on a person's back while manipulating an air tube 36, as explained below.

The internal combustion engine 20 is mechanically attached to drive a fan or air blower 32 which is used to provide a high speed stream of air to an air blower outlet 34 attached to the air blower 32. The air blower 32 is preferably of the centrifugal type although other fans or air blowers suitably devised for operation with the internal combustion engine 20 to provide a steady stream of high speed air could be used in the present invention. An air tube 36 includes an air tube inlet 38 at one end of the air tube 36 adapted for connection to the air blower outlet 34 of the air blower 32. The air tube 36 also has an air tube outlet 40 (FIG. 3) which preferably has a circular outer surface 41 adapted for connection to a sprayer head inlet 98 of a sprayer head 90, as will be further described in detail below.

The air tube 36 is preferably cylindrical or tubular in shape forming a hollow center which is used to channel the air stream from the air blower 32 to the sprayer head 90. The air tube 36 preferably includes a flexible tubular hose portion 42 which is attached using a suitable connector 44 to a preferably straight rigid air tube portion 46. The flexible air tube portion 42 provides a means for manipulation of the straight air tube portion 46 so that an operator can manipulate the air tube 36 to spray in any desired direction. The straight air tube 46 also serves as a handle for the operator which is preferably straight to provide less resistance to the air stream to maintain a steady stream of air provided to the sprayer head 90.

The electrostatic liquid sprayer S includes a liquid reservoir 50 which contains the liquid to be sprayed by the electrostatic sprayer S. The liquid reservoir 50 includes a reservoir outlet 52 which provides the liquid in the liquid reservoir 50 to a flexible hose 54. The hose 54 has a hose inlet 56 attached to the reservoir outlet 52 and a hose outlet 58 which is attached to a nozzle inlet 122 of a nozzle 120 (FIG. 3) used to provide the liquid to the sprayer head 90. The hose 54 preferably has a suitable length wherein the hose 54 may be located adjacent to the air tube 36 and may also be preferably attached to the air tube 36 in a plurality of convenient locations using ties 60 or any other convenient means to securely hold the hose 54 to the air tube 30. In this manner, the hose 54 is prevented from hindering the operator of the electrostatic sprayer S.

The internal combustion engine 20, the air blower 32 and the liquid reservoir 50 are all mounted upon a support frame 62 which is preferably lightweight yet strong enough to hold the engine 20, blower 32 and reservoir 50 together as a unit which may be positioned on a user's back. The support frame 62 is also preferably made of a conductive material which is grounded to the chassis of the internal combustion engine 20. The support frame 62 preferably is fashioned as a back-pack which includes a conventional harness (not shown) used to securely mount the electrostatic sprayer S as a unit on the operator's back so that the operator can conveniently carry the electrostatic sprayer S while using it.

An example of a commercially available back-pack type air blower, which could be modified to produce an electrostatic sprayer according to the present invention, is the PB-400E power air blower manufactured by Echo. The PB-400E includes a 39.7 cubic centimeter engine which includes electronic ignition and which is connected to an air blower to provide an average air volume of approximately 388 cubic feet per minute. The PB-400E engine and air blower assembly is mounted on a metal frame with a built-in back rest. The PB-400E does not include, however, the liquid reservoir 50, the hose 54, the conductive wires 64 and 68 and the sprayer head 90 which must subsequently be added. Of course, any comparable air blower known in the industry could be used.

A ground wire 64 is electrically grounded to the support frame 62 using a suitable ground connection 66. If the support frame 62 is not made of a conductive material or is not grounded to the chassis of the internal combustion engine 20, the ground connection 66 is attached directly to the chassis of the internal combustion engine 20. The ground wire 64 has a suitable length wherein it may be fastened to the hose 54 and the air tube 36 and routed to the sprayer head 90 for connection as will be described below. A high voltage wire 68 is connected to a voltage tap 80 (FIG. 2) wherein the high voltage wire 68 also has a suitable length so that it may be routed from the spark plug boot 26 along the length of the hose 54 and air tube 36 to the sprayer head 90 for connection as described below. The ground wire 64 and the high voltage wire 68 conduct the high voltage pulses from the output of the magneto 24 to the sprayer head 90 to establish an electrostatic field as will be further described below.

Referring now to FIG. 2, a partial cross-sectional view taken along lines 2—2 of FIG. 1 is shown illustrating the voltage tap 80. The spark plug 70 includes threads 72 on the body of the spark plug 70 which mechanically attaches and electrically connects the spark plug 70 to the chassis of the internal combustion engine 20. This provides an electrical path to ground relative to the high voltage output of the magneto 24 as is well known to those skilled in the art. The spark plug boot 26 is normally fashioned for connection directly to the high voltage terminal 74 of the spark plug 70. In the preferred embodiment of the present invention, however, a voltage tap 80 is preferably designed with a first end 76 adapted for connection to the high voltage terminal 74 of the spark plug 70 and a second end 78 adapted for connection to the spark plug connector 30 of the spark plug boot 26. The voltage tap 80 is preferably a conductive piece of brass tubing having a suitable length so that the high voltage output from the magneto 24 is conducted to the high voltage terminal 74 of the spark plug 70 and also to an exposed outer surface 82 of the voltage tap 80 which provides access to the high voltage output from the magneto 24. In this manner, the high voltage wire 68 is electrically connected to the exposed outer surface 82 of the voltage tap 80 by soldering, welding, or any other type of electromechanical connection.

Referring now to FIG. 3, a partial cross-sectional view of the sprayer head 90 is shown taken in the longitudinal direction. The sprayer head 90 is tubular, preferably cylindrical in shape including an outer wall 92 surrounding a hollow center area 94. The outer wall 92 includes a first end which serves as the sprayer head inlet 98 and a second end serving as a sprayer head outlet 99. The outer wall 92 forms a resulting inner surface 96 which faces the hollow center area 94 and which is tubular preferably circular having a diameter approximately equal to the diameter of the outer surface 41 of the air tube outlet 40 so that the air tube outlet 40 fits snugly within the sprayer head inlet 98. The air tube outlet 40 is preferably attached to the sprayer head inlet 98 using one or more depressible tabs 100 which align with corresponding holes provided in the inner surface 96 of the sprayer head 90, although other means of attachment as known to those skilled in the art could be used. In this manner, the stream of air provided from the air blower 32 is channeled through the air hose 36, through the hollow center area 94 of the sprayer head 90 and out of the sprayer head outlet 99 in a direction generally shown by arrows 102.

A venturi 104 is provided within the hollow center area 94 of the sprayer head 90 to accelerate the air stream from the air tube 36 through the sprayer head 90 to form a low pressure area. In the preferred embodiment, the venturi 104 comprises a slanted wall portion 106 which is integrally formed with the outer wall 92 starting from a point 108 slanting upwards into the hollow center area 94 and towards the sprayer head outlet 99. The slanted wall portion 106 terminates at a segment line 109 which extends to and is integrally formed with the opposing sides of the inner surface 96 of the circular outer wall 92 such that the slanted wall portion 106 is generally triangular in shape. The slanted wall 106 is integrally formed with a preferably straight horizontal portion 110 at the segment line 109 having a width such that the horizontal portion 110 extends between and is integrally formed with the opposing sides of the outer wall 92 and a length which extends to the sprayer head outlet 99 such that the horizontal portion 110 is integrally formed with the outer wall 92 along its length. A segment shaped wall portion 112 is integrally formed between the straight portion 110 and the outer wall 92 at the sprayer head outlet 99.

The venturi 104 serves to consume a portion of the hollow center area 94 near the sprayer head outlet 99 forming a narrowed air path 114 which functions to decrease the cross-sectional area of the hollow center area 94 near the sprayer head outlet 99 as compared to the cross-sectional area of the hollow center area 94 near the sprayer head inlet 98. In this manner, the air stream traveling in the direction of the arrows 102 from the air tube 36 is accelerated through the narrowed air path 114 due to the venturi 104 thereby decreasing the air pressure in the narrowed air path 114.

A nozzle 120 comprising the nozzle inlet 122 is preferably mounted through the outer wall 92 of the sprayer head 90, generally near the sprayer head outlet 99 and connected to a nozzle outlet 124 which is located in the narrowed air path 114 near the sprayer head outlet 99. In this manner, liquid provided by the reservoir 50 through the hose 54 and the nozzle inlet 122 to the nozzle outlet 124 is extracted from the nozzle 120 due to the low pressure in the narrowed air path 114. The extracted liquid is atomized by the accelerated air stream, distributed into the air stream and projected out of the sprayer head outlet 99 to be deposited onto crops or plants. A particular electrostatic nozzle which could be used in the embodiment of the present invention is disclosed in the U.S. Pat. No. 4,396,157 to Inculet et al., which is hereby incorporated by reference, although other suitable electrostatic nozzles could be used instead.

The venturi 104 is preferably formed to enclose a hollow area 130 between the outer wall 92 and the wall portions 106 and 112, and the horizontal portion 110 to provide a suitable location for a circuit board 132. A high voltage electrode 134 is mounted to the horizontal portion 110 of the venturi 104 exposing a preferably flat top head portion 135 to the narrowed air path 114 to establish an electrostatic field near the sprayer head outlet 99 which inductively charges the atomized particles issuing from the nozzle 120. The electrode 134 is also preferably mounted to the circuit board 132 to securely mount the circuit board 132 within the hollow area 130 The electrode 134 must be electrically connected to a terminal 144 located on the circuit board 132 as will be more fully described below. The ground wire 64 and the high voltage wire 68 routed to the sprayer head 90 are preferably routed through the outer wall 92 of the sprayer head 90 to the hollow area 130 containing the circuit board 132. The wires 64 and 68 are connected to the circuit board 132 as more fully described below.

Referring now to FIG. 4, a front view of the sprayer head 90 is shown looking along lines 4—4 of FIG. 3. FIG. 4 more clearly shows the cylindrically shaped outer wall 92 of the sprayer head 90 and the cross-sectional area of the narrowed air path 114 formed by the venturi 104. The venturi 104 consumes a segment of the circular shaped outer wall 92 to form the narrowed air path 114. The nozzle outlet 124 is preferably mounted radially opposite the venturi 104.

Referring now to FIG. 5, a top view of the circuit board 132 is shown. The ground wire 64 is attached to the circuit board 132 at a ground terminal 140. The high voltage wire 68 is connected to a terminal 142 to provide the high voltage pulses from the voltage tap 80 to the circuit board 132 The electrode 134 is electrically connected to the circuit board at an electrode terminal 144. A resistor capacitor (RC) filter circuit 146 composed of multiple resistors and capacitors is preferably connected between the ground terminal 140 and the electrode terminal 144. A rectifier circuit 148 is preferably connected between the electrode terminal 144 and the terminal 142. A high value resistor 150 is preferably connected between the terminal 142 and the ground terminal 140.

Referring now to FIG. 6, an electrical schematic diagram of the electrical circuit mounted on the circuit board 132 is shown. The RC filter circuit 146 preferably comprises four Capacitors 152, 154, 156 and 158 connected in series between the ground terminal 140 and the electrode terminal 144. A series of resistors 160, 162, 164, and 166 are each connected in parallel, respectively, to the capacitors 152–158. The rectifier circuit 148 preferably comprises 3 high voltage diodes 168, 170, and 172 connected in series between the electrode terminal 144 and the terminal 142. The anode of the diode 168 is connected to the electrode terminal 144 and the cathode of the diode 168 is connected to the anode of the diode 170. The cathode of the diode 170 is connected to the anode of the diode 172 and the cathode of the diode 172 is connected to the terminal 142. The resistor 150 is connected between the ground terminal 140 and the terminal 142. In the preferred embodiment, the voltage pulses provided by the output of the magneto 24 are negative voltage pulses having a large magnitude using a positive ground. If a negative ground is used, the diodes 168–172 should be reversed. It is understood that other implementations of the RC filter and rectifier circuit could be used as known to those skilled in the art.

The operation of the RC filter and rectifier circuits 146 and 148 mounted on the circuit board 132 will now be described. The voltage pulses from the magneto 24 are provided to the terminal 142 through the high voltage wire 68 biasing the diodes 168–172 on so that current flows from the ground terminal 140 through the capacitors 152–158 and through the diodes 168–172. The capacitors 152–158 are therefore charged to approximately the magnitude of the voltage pulse provided to the terminal 142 minus the voltage drops across the diodes 168–172, so that this voltage develops at the electrode terminal 144. The voltage pulses from the magneto 24 are of very short duration such that voltage at the terminal 142 quickly drops back to ground thereby turning off the diodes 168–172. resistors 160–164 and partly through the electrode 134. The operation of the capacitors 152–158 serve to hold the charge at the electrode terminal 144 thereby increasing the average voltage at the electrode 134 to a preferable level of approximately 2 kilovolts or more. The actual voltage will vary depending upon the speed of the internal combustion engine 20.

FIG. 7 is a graphical illustration of the voltage at the electrode terminal 144. Voltage V is plotted on a vertical axis 180 as a function of time t on a horizontal axis 182 illustrating the saw-toothed waveform 184 of the voltage provided to the electrode terminal 144 and the electrode 134. Therefore, the short duration high magnitude voltage pulses from the magneto 24 are converted to the saw-toothed waveform 184 at the electrode 134 to thereby increase the average voltage and increase the effectiveness of the electrostatic field developed near the sprayer head outlet 99. The electrostatic field provided by the electrode 134 inductively charges the atomized particles issuing from the nozzle 120 so that the droplets are electrostatically attached to the leaves of the plants or crops being sprayed.

Having described the invention above, various modifications of the techniques, procedures, material and equipment will be apparent to those in the art. It is intended that all such variations within the scope and spirit of the appended claims are embraced thereby.

We claim:

1. A portable electrostatic liquid sprayer, comprising:

an internal combustion engine including a chassis and a magneto for providing a relatively high voltage relative to said chassis;

an air blower adapted to be driven by said engine having an air blower outlet, said air blower providing an air stream out of said outlet;

an air hose having an inlet and an outlet, with the inlet connected to said air blower outlet for channeling the air stream therethrough;

a sprayer head mounted to said air hose outlet and having a venturi and an outlet, said sprayer head comprising a tubular wall having a first end and a second end wherein said second end forms said sprayer head outlet, wherein said wall forms a hollow center at a resulting inner surface facing said hollow center, wherein said venturi includes a venturi-forming wall mounted on said inner surface near said sprayer head outlet such that the cross-sectional area of said hollow center at said venturi near said second end is less than the cross-sectional area at said first end, and wherein said sprayer head receives the air stream provided by said air hose and said venturi accelerates the air stream through said sprayer head and out of said sprayer head outlet;

a nozzle mounted on said sprayer head in the accelerated air stream;

means for supplying liquid to said nozzle so that the accelerated air stream extracts liquid from said liquid supply means through said nozzle, and the accelerated air stream atomizes the liquid into particles and distributes the atomized liquid particles into the accelerated air stream;

an electrode mounted on said sprayer head near said sprayer head outlet; and an electrical connection from said internal combustion engine to said electrode to supply said relatively high voltage from said magneto to inductively charge the atomized liquid particles.

2. The sprayer of claim 1, wherein said internal combustion engine further includes a spark plug having a body mounted and electrically grounded to said chassis and a high voltage terminal, a spark plug boot electrically coupled to said magneto for conducting said relatively high voltage, and means electrically coupled between said spark plug boot and said spark plug high voltage terminal for electrically tapping said relatively high voltage provided by said magneto.

3. The sprayer of claim 2, wherein said tapping means comprises a conductive brass tube having a first end for receiving said spark plug boot and a second end for receiving said spark plug high voltage terminal.

4. The sprayer of claim 1, wherein said electrical connection to said electrode further includes a filtering and rectifying circuit electrically coupled to said electrode.

5. The sprayer of claim 4, wherein said filtering and rectifying circuit comprises:

a circuit board mounted to said sprayer head having a ground terminal, a first terminal connected to said electrode and a second terminal;

an electrical conductor electrically coupled to said relatively high voltage of said magneto, routed to said circuit board and connected to said second terminal;

a resistor capacitor filter mounted on said circuit board and electrically connected between said ground terminal and said first terminal;

a rectifier mounted on said circuit board including an anode connected to said first terminal and a cathode connected to said second terminal;

a high value resistor mounted on said circuit board and electrically connected between said second and ground terminals; and a ground wire electrically coupled to said chassis, routed to said circuit board and connected to said ground terminal.

6. The sprayer of claim 1, wherein said air hose comprises a flexible tubular portion having a first end forming said air hose inlet and a second end integrally formed with a substantially straight rigid tubular portion.

7. The sprayer of claim 1, wherein said nozzle is mounted to said wall radially opposite said venturi-forming wall.

8. The sprayer of claim 1, wherein a venturi hollow portion is formed between said wall inner surface and said venturi-forming wall;

said electrical connection to said electrode includes a circuit board having a ground, a first and a second terminal;

said circuit board is mounted to said sprayer head within said venturi hollow portion;

said electrode is mounted to said venturi-forming wall electrically connected to said first terminal;

an electrical conductor is coupled to said relatively high voltage of said magneto, routed to said circuit board through said wall and connected to said second terminal; and a ground wire is electrically coupled to said engine chassis, routed to said circuit board through said wall and connected to said circuit board ground terminal.

9. The sprayer of claim 1 wherein said liquid supplying means comprises a liquid reservoir containing liquid to be sprayed and including an outlet and a flexible hose routed between said reservoir and said sprayer head, said hose having a first end connected to said liquid reservoir outlet and a second end connected to said nozzle.

* * * * *

UNITED STATES PATENT AND TRADEMARK OFFICE

CERTIFICATE OF CORRECTION

PATENT NO. : 5,240,186

DATED : August 31, 1993

INVENTOR(S) : Richard B. Dobbins, et al.

It is certified that error appears in the above-identified patent and that said Letters Patent is hereby corrected as shown below:

In col. 6, line 51, after "130" please insert --.--.

In col. 7, line 6, after "132" please insert --.--.

In col. 7, line 55, after "168-172." please insert --The capacitors 152-158 slowly discharge through the--.

Signed and Sealed this

Twenty-second Day of March, 1994

Bruce Lehman

*Attest:*

BRUCE LEHMAN

*Attesting Officer*

*Commissioner of Patents and Trademarks*